US005277620A

United States Patent [19]

Taylor

[11] Patent Number: 5,277,620

[45] Date of Patent: Jan. 11, 1994

[54] ILLUMINATING RECEPTACLE

[76] Inventor: Terry A. Taylor, 34 Channing St., Winnipeg, Manitoba, Canada, R2R 1T2

[21] Appl. No.: 957,085

[22] Filed: Oct. 7, 1992

[51] Int. Cl.[5] ..... H01R 3/00

[52] U.S. Cl. ..... 439/488; 439/910; 439/372; 439/534

[58] Field of Search ..... 439/490, 910, 372, 527, 439/534, 484, 928, 929, 488; 362/95, 145

[56] References Cited

U.S. PATENT DOCUMENTS

| | | | |
|---|---|---|---|
| 1,243,490 | 10/1917 | Denhard | 439/534 |
| 3,265,888 | 8/1966 | Adolphson, Jr. | 439/490 |
| 3,297,886 | 1/1967 | Danner | 439/490 |
| 3,611,247 | 10/1971 | Adams | 439/910 |
| 3,775,727 | 11/1973 | Wise | 439/490 |
| 3,895,225 | 7/1975 | Prior | 240/2 R |
| 3,924,914 | 12/1975 | Banner | 439/490 |
| 4,546,419 | 10/1985 | Johnson | 362/95 |
| 4,875,152 | 10/1989 | Foster | 439/490 |
| 4,951,182 | 8/1990 | Simonson et al. | 362/145 |

FOREIGN PATENT DOCUMENTS

| | | | |
|---|---|---|---|
| 2184615 | 6/1987 | United Kingdom | 439/910 |

*Primary Examiner*—Gary F. Paumen
*Assistant Examiner*—Hien D. Vu
*Attorney, Agent, or Firm*—S. Michael Bender

[57] ABSTRACT

A new and improved electrical receptacle comprising a light permeable housing, electrical outlets mounted in the housing, and illuminating means disposed interiorly of the housing. In an alternatively preferred arrangement, a stand pivotally attached to the receptacle housing is adapted to elevate the receptacle thereby affording protection against short circuits due to excessive moisture on the floor. In yet another alternatively preferred arrangement, a second pivotal attachment on the housing is effective to prevent the inadvertent disconnection of electrical cords plugged into the housing.

11 Claims, 4 Drawing Sheets

ILLUMINATING RECEPTACLE

BACKGROUND OF THE INVENTION

1. Field of the Invention

The present invention relates generally to electrical receptacles, and more particularly, to electrical receptacles having self-contained means for illuminating the housing in which the electrical receptacles are mounted.

2. Description of the Prior Art

Electrical receptacles attached to one end of a power cord or electrical conductor are well known. Such devices, commonly referred to as "extension cords", are used widely to enable electrical appliances to be plugged in and turned on where for one reason or another, a wall-mounted receptacle is not conveniently present. In addition, the combination of a wall-mounted electrical receptacle and an illuminating device attached to the receptacle is known (U.S. Pat. No. 3,895,225). Also known is the use of a "night-light" mounted in an outlet box in a wall and having an electric receptacle therewith (U.S. Pat. No. 4,546,419); and the combination of electrical power outlets with illumination means in a tower module for use at marinas (U.S. Pat. No. 4,951,182). None of the prior arrangements, however, contemplate the provision of an illuminated receptacle attached to an electrical conductor so as to facilitate safe access to electrical power low-light or darkness conditions. The foregoing disadvantage is overcome by the unique electrical receptacle arrangement of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved electrical receptacle comprising a light permeable housing, electrical outlets mounted in the housing, and illuminating means disposed interiorly of the housing. In an alternatively preferred arrangement, a stand pivotally attached to the receptacle housing is adapted to elevate the receptacle thereby affording protection against short circuits due to excessive moisture on the floor. In yet another alternatively preferred arrangement, a second pivotal attachment on the housing is effective to prevent the inadvertent disconnection of electrical cords plugged into the housing.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least three preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved illuminating receptacle which has all of the advantages of the prior art and none of the disadvantages.

It is another object of the present invention to provide a new an improved illuminating receptacle which may be easily and efficiently manufactured and marketed.

It is a further objective of the present invention to provide a new and improved illuminating receptacle which is of durable and reliable construction.

An even further object of the present invention is to provide a new and improved illuminating receptacle which is susceptible of a low cost of manufacture with regard to both materials and labor, and which accordingly is then susceptible of low prices of sale to the consuming public, thereby making such illuminating receptacle economically available to the buying public.

Still a further object of the present invention is to provide a new and improved illuminating receptacle which provides in the apparatuses and methods of the prior art some advantage thereof, while simultaneously overcoming some of the disadvantages normally associated therewith.

Still yet a further object of the present invention is to provide a new and improved illuminating receptacle that is safe to operate in remote locations.

It is still a further object of the present invention is to provide a new and improved illuminating receptacle capable of being safely used in wet environments.

Still a further object of the present invention is to provide a new and improved illuminating receptacle including means for preventing unwanted disconnection of electrical appliance cords plugged into the receptacle.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

Figure 1:
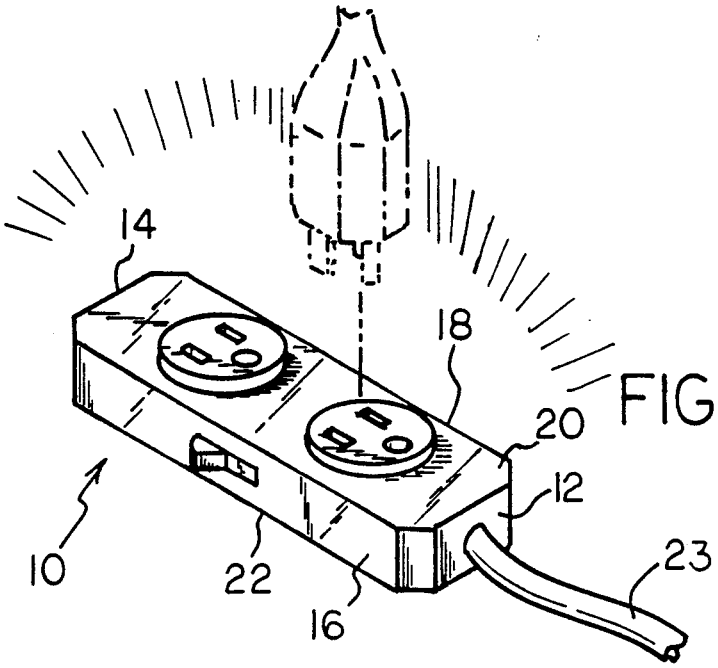
FIG. 1 is a perspective view showing the first preferred embodiment of the illuminating receptacle of the present invention.

With reference now to the drawings, a new and improved illuminating receptacle embodying the principles and concepts of the present invention will be described.

Turning initially to FIGS. 1-4, there is shown a first exemplary embodiment of the illuminating receptacle of the invention generally designated by reference numeral 10. In its preferred form, illuminating receptacle 10 comprises a generally rectangular shaped housing having a pair of opposed end walls 12, 14; a pair of opposed side walls 16, 18; a top wall 20 and an opposed bottom wall 22. In accordance with the invention, one or more of the walls of the housing are light permeable; that is, sufficiently transparent or translucent to permit a light source disposed inside the housing to be visible to an observer outside the housing. A suitable exemplary material for the receptacle housing is a conventional transparent acrylic plastic which is mostly preferred and which may be molded to form the rectangular shape shown. In this regard, the bottom wall preferably is molded as a separate part and is adapted to be fastened to a molded shell comprising the end walls, the side walls, and the top wall, via a plurality of threaded screws or the like. It will be appreciated that in the preferred embodiment, all of the walls of the housing are rendered light permeable. Nonetheless, in practicing the present invention, it should be understood that the walls may instead be opaque as long as at least one or more of the walls, preferably including the top wall, is light permeable.

Figure 2:
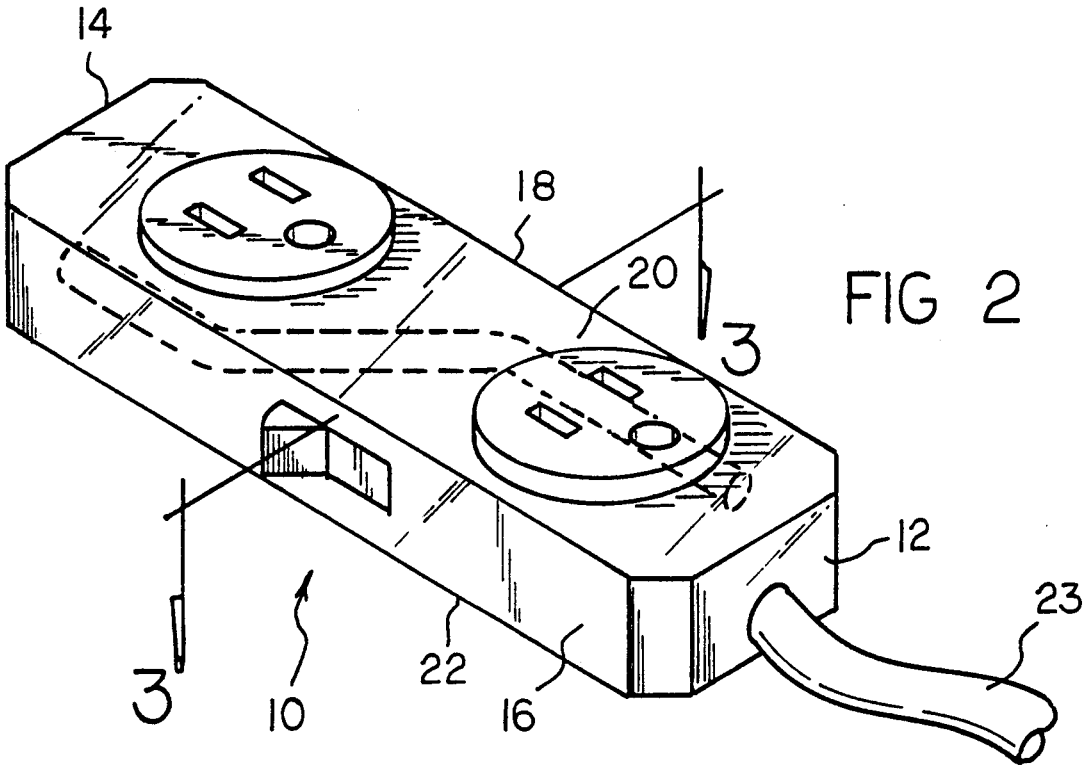
FIG. 2 is an enlarged perspective view of the illuminating receptacle of FIG. 1.
Figure 3:
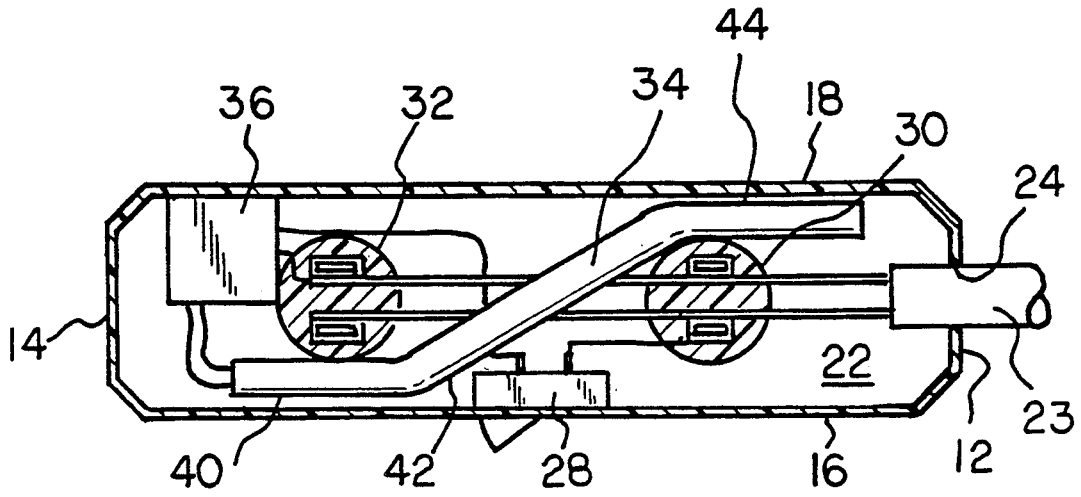
FIG. 3 is a cross-section view of the illuminating receptacle of FIG. 2 taken along line 3—3 thereof.
Figure 4:
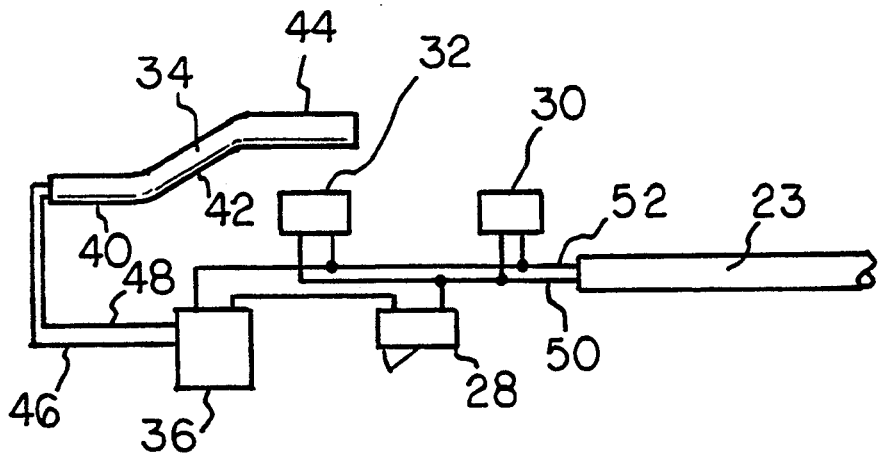
FIG. 4 is a schematic circuit diagram of the illuminating receptacle of the invention.

As best seen in FIG. 3, end wall 14 is provided with a suitable passage 24 therein for permitting the terminal end of a conventional two-wire insulated electrical cord 23 to be trained through passage 24. Preferably, a grommet (not shown) is seated in a suitable manner within passage 24 to provide a tight seal of the interior of the receptacle housing against moisture and foreign matter. Another passage, this one of rectangular shape is provided in side wall 16 to permit access to a conventional single-pole double throw "on-off" switch 28 mounted on the inside surface of side wall 16 substantially as shown. Fixedly secured in a suitable manner inside the interior of the receptacle housing, is a pair of electrical power receptacle or outlet units 30, 32; an illuminating tube 34 of either the neon or fluorescent type; and a starter unit or transformer 36 for the illuminating tube. These parts are conventional and the details of their construction are outside the scope of the present invention. Suffice it say, the foregoing components, suitable for use in the present invention are readily obtainable commercially from virtually any electrical parts supply establishment. As shown in FIGS. 1 and 2, the face of each receptacle or outlet unit 30, 32 extends through suitable recesses in top wall 20 in the usual spaced manner to present a pair of electrical receptacles or outlets adapted to receive the plug ends of a pair of electrical appliances (one of which is indicated by broken lines in FIG. 1).

Illuminating tube 34 is configured to extend parallel to the inside surface of side wall 16, then veer off at an obtuse angle to extend between receptacle units 30, 32, and finally, is bent back at substantially the same obtuse angle to extend parallel to the inside of side wall 18. Hence, illuminating tube 34 has a first end portion 40, a second intermediate portion 42, and a distal third portion 44. By this "snaking" arrangement, illuminating tube 34 is adapted when energized to provide a source of light capable of uniformly illuminating the entire receptacle housing. Suitably mounted adjacent first portion 40 on the inside of side wall 18 is the illuminating tube starter unit 36. As diagrammatically presented in FIG. 4, the starter is connected via leads 46, 48 to the first portion of tube 34. Electrical cord 23 has a high-voltage lead 50 and a low-voltage or common lead 52 which are connected across the receptacle units in a conventional manner (i.e. in parallel). Leads 50 and 52 also are connected in series with switch 28 and starter 36, Hence, when switch 28 is thrown to its "on" position, the starter unit fires illuminating tube 34 and receptacle or outlet units 30, 32 are energized to deliver electrical power to any suitable appliance plugged therein.

It will be understood that switch 28 is optional and may be omitted entirely, in which case starter 36 will be connected directly to leads 50 and 52. When switch 28 is omitted, the starter will fire the illuminating tube when electrical cord 23 is plugged into an external source of power and the illuminating receptacle will remain both energized and illuminated in its normal condition of use.

In use, illuminating receptacle 10 may be used to furnish electrical power in remote locations where there is an absence of light, or to indicate the presence of the receptacle housing in low light conditions, or merely to indicate a "power on" condition. Owing to the "snaked" design of the illuminating tube inside the receptacle housing and the light permeable character of the receptacle housing, high illumination efficiency is achieved and visibility of the illuminated receptacle from even remote distances is quite excellent.

Figure 5:
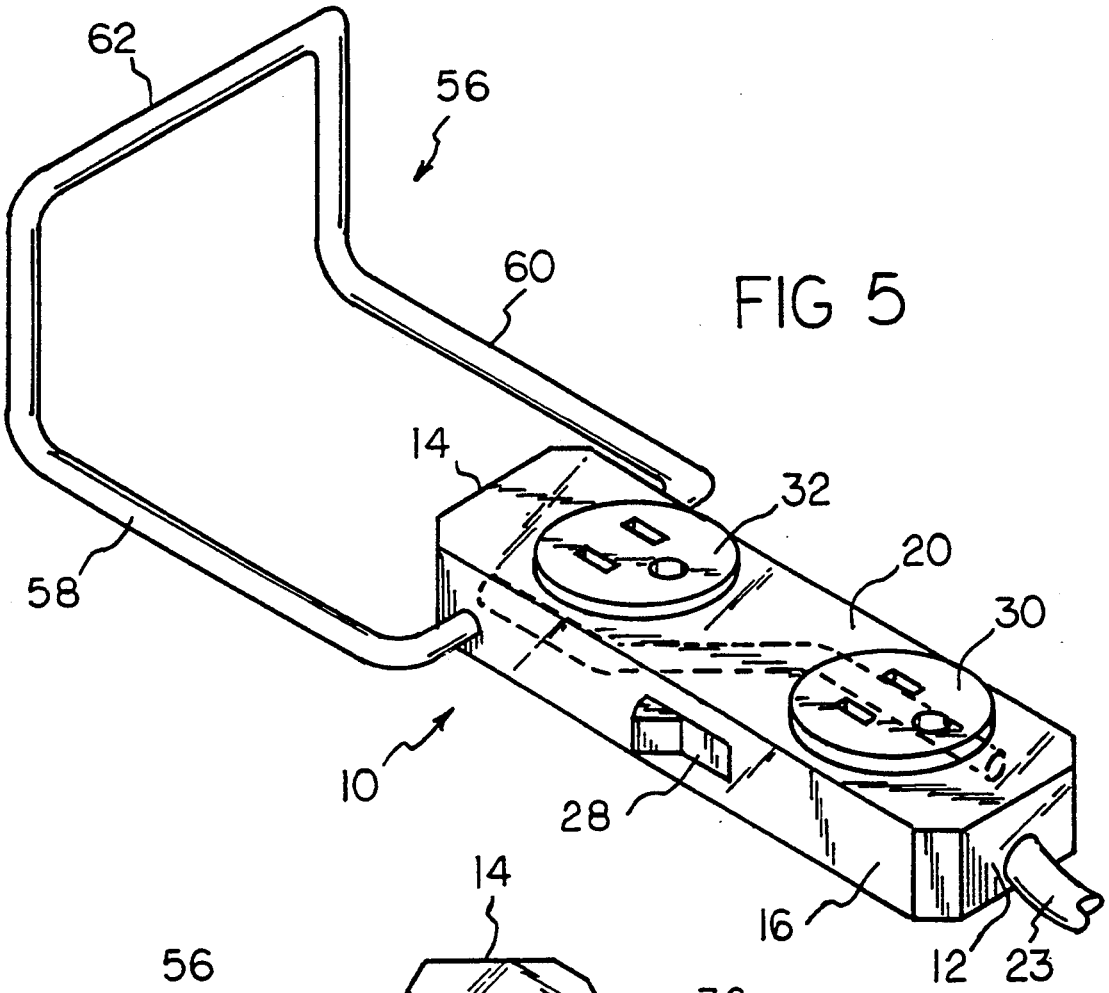
FIG. 5 is a perspective view in elevation of a second preferred embodiment of the invention.
Figure 6:
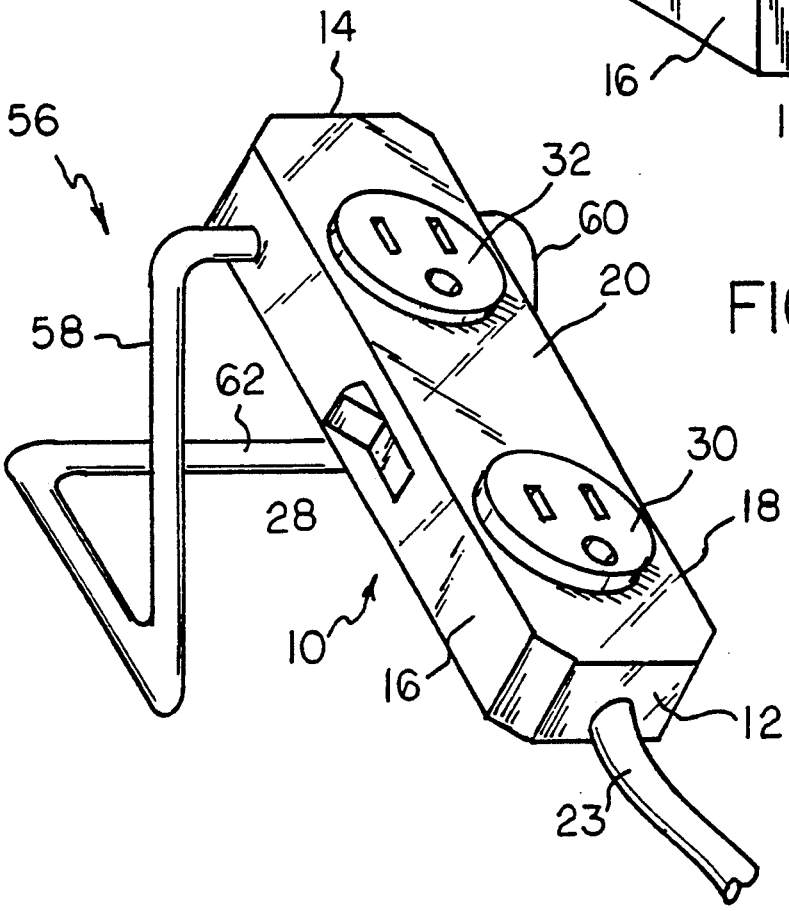
FIG. 6 is a perspective view in elevation of the second preferred embodiment of the invention shown in its intended elevated operating position.

Turning to FIGS. 5 and 6, there is shown an alternatively preferred embodiment of the present invention wherein like reference numerals represent like parts. A bail generally designated by reference numeral 56, and preferably fabricated from solid cylindrical aluminum bar stock, has a pair of opposed side legs 58, 60 pivotally attached to receptacle 10. The extremities of side legs 58, 60 are bent inwardly substantially as shown and are received in a corresponding pair of blind holes molded into side walls 16, 18 proximal to end wall 14. The bail thus is adapted to pivot about the housing relative to an imaginary axis coaxial to the blind holes. A cross-bar 62 extending perpendicular to side legs 58, 60 is integrally joined therebetween to form both a convenient grip-handle and stand for the receptacle housing substantially as shown. In this regard, it will be observed that the side legs 58, 60 intermediate their longitudinal extent are bent at right angles so that the distal portion of the bail beyond the right angle bends lies in a plane orthogonal to the plane in which the remainder of the bail lies. As a result of this arrangement, the bail 56 may be pivoted relative to the receptacle housing to the position shown in FIG. 6 to serve as stand for the receptacle sufficient to elevate the receptacle off the floor and enables the receptacle to be safely used to provide electrical power to appliances in a location where it is common to find water or the like on the floor.

Figure 7:
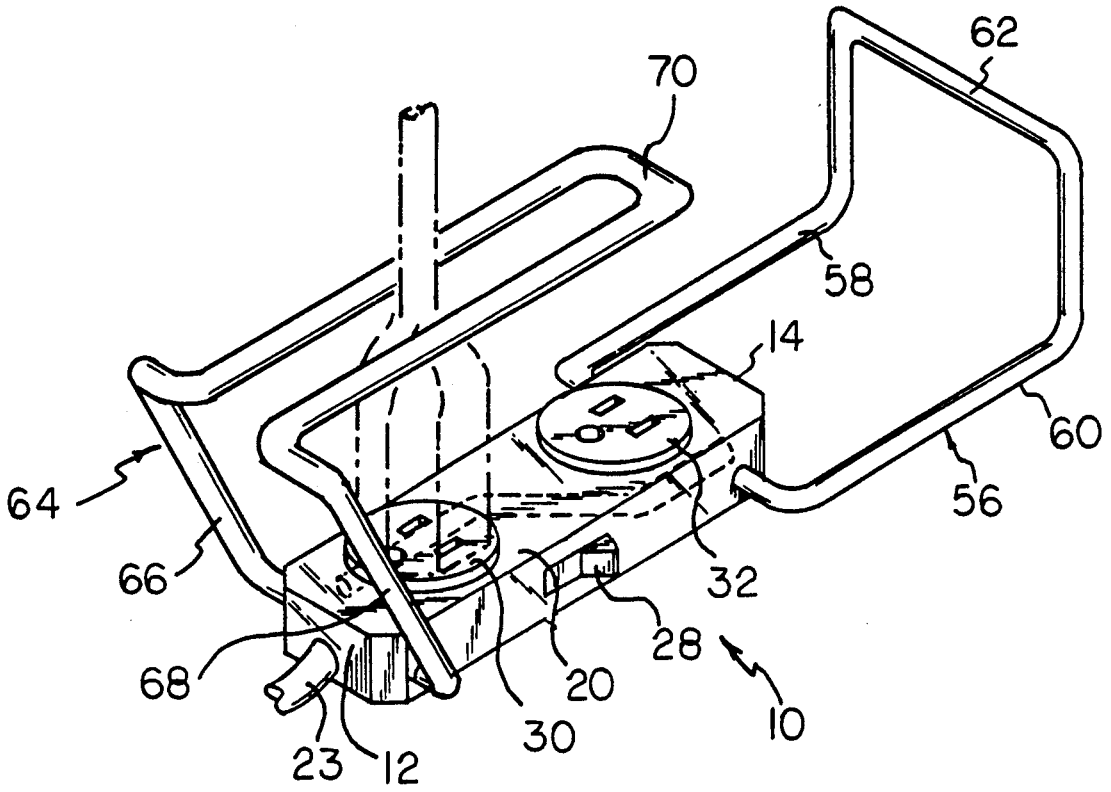
FIG. 7 is a perspective view of a third alternatively preferred embodiment of the invention shown in its intended operating position.

Turning now to FIG. 7, there is shown another alternatively preferred embodiment where again, like reference numerals represent similar parts already described. A second bail member generally designated by reference numeral 64, and also preferably fabricated from solid cylindrical aluminum bar stock, is provided pivotally attached to the receptacle housing at a location proximal to end wall 12, i.e. at the end opposite to that near where bail member 56 is mounted. Similar to the latter, bail member 64 has a pair of opposed side legs 66, 68 pivotally attached to receptacle housing 10. The extremities of side legs 66, 68 are bent inwardly substantially as shown and are received in a corresponding pair of blind holes molded into the side wall 16, 18 proximal to end wall 12. The bail thus is adapted to pivot about the hosing relative to an imaginary axis coaxial to the blind holes. Substantially intermediately thereof legs 66, 68 are bent inwardly at right angles toward each other to form a second pair of legs which latter are again bent at right angles to form a third pair of legs spaced closer to one another than the legs in the first pair thereby defining a relatively narrow channel closed at its distal end by cross-bar 70 integrally joined to the extremities of the third pair of side legs. As shown in FIG. 7, the channel is open at the location of the second series of right angle bends of side legs 66, 68 and the channel extends in a plane orthogonal to the plane of the side legs prior to the second series of right angle bends therein. By this arrangement, when bail member 64 is pivoted relative to the receptacle housing to the position shown in FIG. 7, the channel portion of side legs 66, 68 and cross-bar 70 lies in a plane parallel to and spaced above top wall 20 of the receptacle housing and the mouth of the channel is aligned with end wall 12 of the housing. In accordance with the invention, bail member 64 serves as a retainer for the plug end of any electrical cords engaging the receptacle units sufficient to counteract any twisting or pulling forces on the cords which might tend to unintentionally pull the plugs out of or disconnect them from the receptacle units. In use, the bail is pivoted to the position shown in FIG. 7, and any electrical cord being plugged into the receptacle housing is trained through the open end or mouth of the channel formed by side legs 66, 68 before being plugged in. It will be appreciated that the retainer formed by bail member 64 is fully operational for its intended function even when bail member 56 is functioning as a stand for the receptacle housing (FIG. 6).

It is apparent from the above that the present invention provides a new and improved illuminating receptacle that may advantageously be used in low light or dark conditions, and which further may include means for elevating the receptacle housing permitting it to be safely used in wet environments, and which still further may include means for retaining any electrical cords plugged into the receptacle from being unintentionally pulled out thereby providing a receptacle simple in construction yet having enhanced safety attributes when in use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A new and improved illuminating receptacle comprising:

a housing, electrical receptacle means mounted on said housing and adapted to supply electrical power to a appliance through a conductor having electrical plug means adapted to cooperate with said receptacle means, and an illuminating means disposed inside said housing, said housing having at least one light permeable wall whereby said illuminating means is visible from a point outside said housing, wherein said housing comprises a top wall, a pair of side walls, a pair of end walls, and a bottom wall; said electrical receptacle means being mounted in said housing so as to extend through said top wall, and wherein said at least one light permeable wall comprises said top wall, and wherein said illuminating means comprises a neon tube, and starter means for said neon tube mounted inside said housing, said electrical receptacle means comprising a pair of plug-in receptacle units extending through corresponding recesses in said top wall, said recesses and said units being longitudinally separated from each other to define a space therebetween, said neon tube being mounted in said housing so as extend along one side wall, then at an angle between said units through said space, and then along said other side wall whereby energization of said tube illuminates the entire housing.

2. The illuminating receptacle of claim 1 wherein said illuminating means is connected to an on-off switch, said on-off switch being connected to said electrical receptacle means in such a way that actuation of said switch in one condition causes said illuminating means and said electrical means to become energized, and actuation of said switch to a second condition cases said electrical means and said illuminating means to become deenergized.

3. The illuminating receptacle of claim 1 wherein said top wall, said side walls, and said end walls are light permeable.

4. The illuminating receptacle of claim 1 wherein said switch means extends through one of said side walls, and said electrical receptacle means further includes conductor means connected to said receptacle units, and said conductor means extends through a recess in one of said end walls.

5. The illuminating receptacle of claim 1 wherein said at least one light permeable wall is transparent.

6. The illuminating receptacle of claim 1 wherein said at least one light permeable wall is translucent.

7. The illuminating receptacle of claim 3 wherein said light permeable walls are transparent.

8. The illuminating receptacle of claim of claim 3 wherein said light permeable walls are translucent.

9. The illuminating receptacle of claim 1 wherein said housing has a pair of opposed end walls and conductor means extending through one of said end walls, said conductor means being coupled to said electrical receptacle means inside said housing, and bail means pivotally connected to said housing proximal to said end wall opposite to said end wall through which said conductor extends, said bail in one pivotal position thereof relative to said housing adapted to serve as a stand for said housing whereby said stand supports said end wall of said housing proximal to said pivotal connection at a higher elevation than said other end wall through which said conductor extends.

10. The illuminating receptacle of claim 1 wherein said housing has a pair of opposed end walls and conductor means extending through one of said end walls, said conductor means being coupled to said electrical receptacle means inside said housing, and bail means pivotally connected to said housing proximal to said end wall through which said conductor extends, said bail having first and second portions comprising first and second pairs of spaced legs respectively, the spaced legs in said portions being joined to one another by a third pair of legs disposed at an angle with respect to said first and said second pairs of legs whereby said legs in said second pair are spaced closer to one another then said legs in said first pair to form a channel, said first portion being pivotally connected to said housing, said second portion extending at an angle to said first portion wherein said bail in one pivotal position thereof relative to said housing is adapted to serve as a retainer for electric cords having plug means adapted to engage said electrical receptacle means from outside said housing with said electrical cords extending through said channel whereby said plug means is prevented from unintentionally being disconnected from said receptacle means by forces inadvertently applied to said electrical cords.

11. The illuminating receptacle of claim 1 wherein said housing has a pair of opposed end walls and conductor means extending through one of said end walls, said conductor means being coupled to said electrical receptacle means inside said housing, first bail means pivotally connected to said housing proximal to said end wall opposite to said end wall through which said conductor extends, said bail in one pivotal position thereof relative to said housing adapted to serve as a stand for said housing whereby said stand supports said end wall of said housing proximal to said pivotal connection at a higher elevation than said other end wall through which said conductor extends, and second bail means pivotally connected to said housing proximal to said end wall through which said conductor extends, said bail having first and second portions comprising first and second pairs of spaced legs respectively, the spaced legs in said portions being joined to one another by a third pair of legs disposed at an angle with respect to said first and said second pairs of legs whereby said legs in said second pair are spaced closer to one another then said legs in said first pair to form a channel, said first portion being pivotally connected to said hosing proximal to said end wall through which said conductor extends, said second portion extending at an angle to said first portion such that said second bail in one pivotal position thereof relative to said housing is adapted to serve as a retainer for electric cords having plug means adapted to engage said electrical receptacle means from outside said housing with said electrical cords extending through said channel whereby said plug means is prevented from unintentionally being disconnected from said receptacle means by forces inadvertently applied to said electrical cords.

* * * * *